US011679792B2

(12) United States Patent
Ersch et al.

(10) Patent No.: US 11,679,792 B2
(45) Date of Patent: Jun. 20, 2023

(54) DISTRIBUTED BOGIE DIAGNOSTICS FOR TRACK MONITORING

(71) Applicant: Siemens Mobility GmbH, Munich (DE)

(72) Inventors: Florian Ersch, Plainsboro, NJ (US); Hartmut Ludwig, West Windsor, NJ (US); Thomas Gruenewald, Somerset, NJ (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 512 days.

(21) Appl. No.: 16/646,597

(22) PCT Filed: Sep. 19, 2017

(86) PCT No.: PCT/US2017/052140
§ 371 (c)(1),
(2) Date: Mar. 12, 2020

(87) PCT Pub. No.: WO2019/059881
PCT Pub. Date: Mar. 28, 2019

(65) Prior Publication Data

US 2020/0290659 A1 Sep. 17, 2020

(51) Int. Cl.
*B61L 23/04* (2006.01)
*B61K 9/10* (2006.01)
(Continued)

(52) U.S. Cl.
CPC ..... *B61L 23/042* (2013.01); *B61K 9/10* (2013.01); *B61L 15/0018* (2013.01);
(Continued)

(58) Field of Classification Search
CPC ..... B61K 9/00; B61K 9/10
See application file for complete search history.

(56) References Cited

U.S. PATENT DOCUMENTS 5,987,979 A * 11/1999 Bryan ..... B61L 25/021 73/146
6,064,428 A * 5/2000 Trosino ..... B61L 23/047 348/148
(Continued)

FOREIGN PATENT DOCUMENTS

CN 101607565 A 12/2009
CN 102333687 A 1/2012
(Continued)

OTHER PUBLICATIONS

International Search Report dated Jul. 20, 2018; Application No. PCT/US2017/052140; 13 pages.
(Continued)

*Primary Examiner* — Jess Whittington

(57) ABSTRACT

A method of monitoring a track using train cars includes collecting first sensor data corresponding to a track location by a first sensor network on a first train car. Based on the first sensor data, a potential track anomaly at the track location is identified by a diagnostics system on the first train car. A message describing the anomaly is transmitted to diagnostics systems located on other train cars. The message is received by a second diagnostics system on a second train car located behind the first train car. The second diagnostics system determines a time at which the second train car will be passing over track location and, at the determined time, collects second sensor data. If the track anomaly is present in both the first sensor data and the second sensor data at the track location, a train control system is notified of the track anomaly.

9 Claims, 5 Drawing Sheets

(51) Int. Cl.

| | |
|---|---|
| ***B61L 15/00*** | (2006.01) |
| ***B61L 25/02*** | (2006.01) |
| ***B61L 27/40*** | (2022.01) |
| ***B61L 27/53*** | (2022.01) |
| ***B61L 27/70*** | (2022.01) |

(52) U.S. Cl.
CPC ..... *B61L 15/0081* (2013.01); *B61L 25/025* (2013.01); *B61L 27/40* (2022.01); *B61L 27/53* (2022.01); *B61L 27/70* (2022.01); *B61L 2205/04* (2013.01)

(56) References Cited

U.S. PATENT DOCUMENTS 6,262,573 B1 * 7/2001 Wojnarowski ..... G01M 5/0033 324/217
6,424,150 B2 * 7/2002 Kwun ..... G01N 29/11 324/216
6,553,838 B2 * 4/2003 Amini ..... B61L 23/044 73/644
7,389,694 B1 * 6/2008 Hay ..... G01N 29/265 73/635
7,938,008 B2 * 5/2011 Owens ..... G01N 29/043 73/632
9,211,879 B2 12/2015 Leitel et al.
2001/0019263 A1 * 9/2001 Kwun ..... G01N 29/11 324/217
2002/0065629 A1 * 5/2002 Clark ..... B61D 15/00 702/182
2008/0105791 A1 * 5/2008 Karg ..... B61L 23/044 246/120
2009/0193899 A1 * 8/2009 Panetta ..... G01N 29/30 73/622
2010/0004804 A1 * 1/2010 Anderson ..... B61K 9/08 701/19
2011/0284700 A1 * 11/2011 Brand ..... B61L 15/0036 246/28 R
2013/0284859 A1 * 10/2013 Polivka ..... B61L 27/60 246/34 R
2014/0129154 A1 * 5/2014 Cooper ..... B61K 9/08 702/34
2014/0138493 A1 * 5/2014 Noffsinger ..... B61L 3/121 246/121
2014/0156123 A1 * 6/2014 Cooper ..... G01S 19/50 701/19
2014/0207317 A1 * 7/2014 Noffsinger ..... B61L 23/044 701/19
2014/0277824 A1 * 9/2014 Kernwein ..... B61K 9/08 701/1
2015/0053827 A1 * 2/2015 Noffsinger ..... B61L 3/121 246/121
2015/0183448 A1 * 7/2015 Cooper ..... B61L 23/044 246/34 R
2016/0082991 A1 3/2016 Warta et al.
2016/0159381 A1 6/2016 Fahmy

FOREIGN PATENT DOCUMENTS

CN 202491817 U 10/2012
CN 105460027 A 4/2016
CN 105564468 A 5/2016

OTHER PUBLICATIONS

Chinese Report of Exam dated Jun. 24, 2021; Application No. 2017800949278; 15 pages.

* cited by examiner

DISTRIBUTED BOGIE DIAGNOSTICS FOR TRACK MONITORING

CROSS REFERENCE TO RELATED APPLICATIONS

This application is a national phase filing under 35 U.S.C. § 371 of International Patent Application No. PCT/US2017/052140, filed Sep. 19, 2017, which is incorporated herein by reference in its entirety.

TECHNICAL FIELD

The present invention relates generally to methods, systems, and apparatuses for monitoring track anomalies using plurality of bogie sensor systems installed on a plurality of train cars. The technology described herein may be used for track and bogie anomaly detection, as well as generating maps of tracks.

BACKGROUND

A bogie is the wheel chassis of a train on which the train wagon rides. A typical train wagon has two bogies. New bogie systems contain sensors to monitor the health of the bogie. Thus, for example, a bogie may have sensors to monitor the roundness of the wheels, the temperature of the axle box bearing and gearbox, shaft bending, resonances, oil temperature, oil level, and various vibration levels. The data collected by the sensor systems is used to detect damage to the bogie system in its early stages before mechanical failures occur. Using this information, parts can be repaired or replaced as necessary during maintenance of the train system. Although the bogie sensor systems collect a great deal of data, conventional systems typically operate independently and there is little or no collaboration between different sensor systems.

The bogie sensor system may also be used to monitoring the condition of the track on which the train rides. For example, if the bogie sensor system measures an unexpected shock or vibration at a particular location, it may label the location as having an anomaly. However, because of the lack of coordination and collaboration, it is challenging to determine whether the unexpected shock or vibration is the result of determination or failure of the bogie's mechanical system or whether there is a true anomaly in the track. Accordingly, it is desired to provide technology for enhanced detecting, classifying, and verification of anomalies that occur while the bogie is in motion.

SUMMARY

Embodiments of the present invention address and overcome one or more of the above shortcomings and drawbacks by providing methods, systems, and apparatuses related to a bogie monitoring system for detecting, classifying, and verifying anomalies in the bogie system itself, as well as anomalies on the track on which the train rides.

According to some embodiments, a method of monitoring a track using a train comprising a plurality of train cars includes collecting first sensor data corresponding to a track location by a first sensor network on a first train car and, based on the first sensor data, identifying a potential track anomaly at the track location by a first diagnostics system on the first train car. A message describing the anomaly is transmitted from the first diagnostics system to diagnostics systems located on one or more other train cars included in the train. The message comprises an indication of the track location. The message is received by a second diagnostics system on a second train car located behind the first train car with respect to the train's direction of travel. The second diagnostics system determines a time at which the second train car will be passing over track location and, at the determined time, collects second sensor data at the track location by a second sensor network on the second train car. If the track anomaly is present in both the first sensor data and the second sensor data at the track location, a train control system is notified of the track anomaly.

Various enhancements, refinements, and other modifications can be made to the aforementioned method in different embodiments. For example, in one embodiment, prior to collecting the second sensor data and in response to receiving the message, one or more of the following may occur: the sampling speed of the second sensor network on the second train car may be increased, data collection algorithms with functionality related to detection of the anomaly may be enabled, and/or data collection algorithms with functionality unrelated to detection of the anomaly may be disabled. In some embodiments, the track location is determined based on a Global Positioning System (GPS) signal received by the first diagnostics system on the first train car. In other embodiments, the train's sensors read location markings on the track and use the readings to determine track location.

According to other embodiments, a second method of monitoring a track using a train comprising a plurality of train cars includes collecting first sensor data corresponding to a track location by a first sensor network on a first train car. Based on the first sensor data, a potential track anomaly may be identified at the track location by a first diagnostics system on the first train car. The potential track anomaly is correlated (i.e., confirmed) based on second sensor data corresponding to the track location collected by a second sensor network on a second train car. Then, a map of the track is updated to indicate a track anomaly at the track location. In some embodiments, a train control system located on the train sends the map of the track to at least one system external to the train.

According to other embodiments, a system for diagnosing anomalies during operations of a train includes a plurality of bogie diagnostics computer systems distributed among a plurality of train cars included in the train. The bogie diagnostics computer system at each train car comprises one or more processors, a bogie interface, a plurality of analysis programs, and a diagnostics program. The bogie interface is configured to collect sensor data from each bogie coupled to the train car according to a sampling rate. The analysis programs are executable by the processors. These analysis programs comprise an anomaly detection program and one or more other programs. The anomaly detection program is configured to detect track anomalies based on the sensor data collected by the bogie interface. The diagnostics program is also executable by the processors and it controls operation of the analysis programs. The aforementioned system further includes a communication network connecting the plurality of bogie diagnostics computer systems.

In some embodiments of the aforementioned system, the diagnostics program is configured to increase the sampling rate of the anomaly detection program in response to receiving an anomaly detection message from at least one other bogie diagnostics computer system. Alternatively (or additionally), the diagnostics program may disable all analysis programs other than the anomaly detection program. In some embodiment, as anomalies are detected, the anomaly detection program transmits an anomaly detection message to each bogie diagnostics computer system in the train, for example, by a broadcast or multicast message.

Some embodiments of the aforementioned system further include a train control system. This system is configured to receive an anomaly detection message and anomaly confirmation message from bogie diagnostics systems on the train. In response to receiving the anomaly confirmation message, the train control system sends a notification of the track anomalies to at least one system external to the train.

Additional features and advantages of the invention will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there are shown in the drawings exemplary embodiments that are presently preferred, it being understood, however, that the invention is not limited to the specific instrumentalities disclosed. Included in the drawings are the following Figures.

DETAILED DESCRIPTION

The following disclosure describes the present invention according to several embodiments directed at methods, systems, and apparatuses related to a bogie monitoring system for detecting, classifying, and verifying anomalies that occur while the bogie is in motion. This bogie monitoring system includes a bogie diagnostics computer system installed at each train car. Each computer system is connected via a data network so that anomalies and other information can be shared. Location information (e.g., via GPS) is available for the position of the bogie (e.g., via a link to the train control system). By enabling the diagnostics computer systems to share data amongst each other, a more robust root cause analysis is possible. Moreover, with the technology described herein, no additional equipment other than the bogie diagnostics equipment is required to monitor the "health" of a train track.

Figure 1:
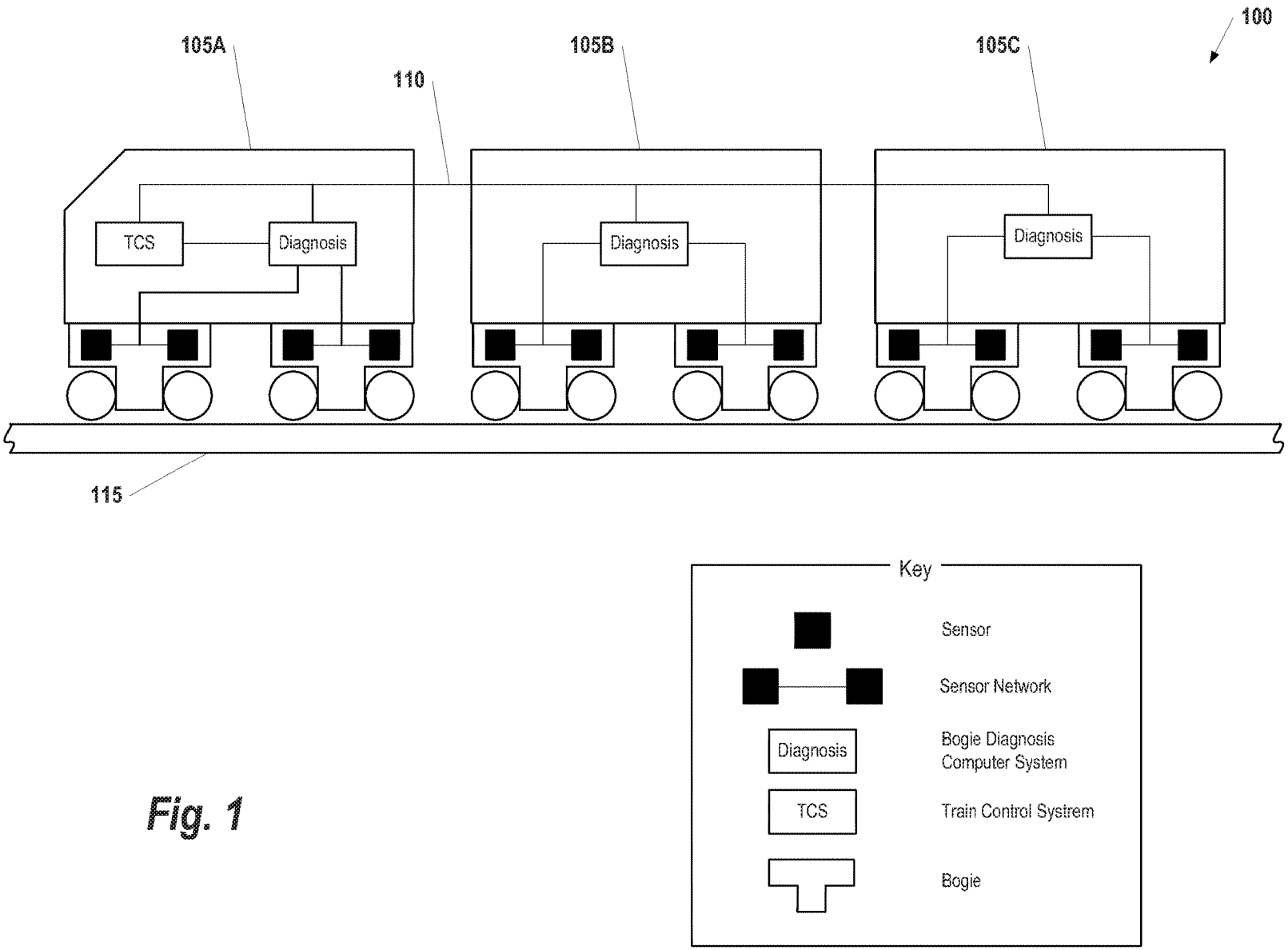
FIG. 1 illustrates a system for diagnosing anomalies during operations of a train, according to some embodiments.

FIG. 1 illustrates a system 100 for diagnosing anomalies during operations of a train, according to some embodiments. In this example, the train comprises three train cars 105A, 105B, 105C running on a track 115. Each train car 105A, 105B, 105C is coupled to two bogies. Each bogie includes multiple sensors connected via a sensor network internal to the bogie. The types of sensors used in the sensor network may include, for example, capacitive sensors, piezoelectric sensors, piezoresistive sensors, or Microelectromechanical systems (MEMS) sensors. It should be noted that, although two sensors are shown in the illustration presented in FIG. 1; however, in practice, the number of sensors may be much greater. For example, in one embodiment, each sensor network includes 20-30 sensors. The types of information collected by the sensors may include, for example, speed, acceleration, temperature, humidity, and vibration.

Each train car 105A, 105B, 105C includes a bogie diagnostics computer system that collects sensor data from the sensor networks of its bogies. Based on the collected sensor data, the bogie diagnostics computer system detects anomalies on the track. If a bogie diagnostics computer system for one train car identifies an anomaly, it could be attributed to a failure in the bogie or a failure in the track. The bogie diagnostics computer system that detected the anomaly may then request the data for the specific track location where it detected the anomaly from other bogies. It can now correlate its result with the results from the other bogies. For example, if multiple bogie diagnostics computer systems identify the same characteristics, it is a strong indication, that the issue is in the track and not in the bogie.

The operational parameters of the bogie diagnostics computer system may include amongst other, the sensor data acquisition speed, the selection of algorithms that to do the analysis (e.g., which issues to detect) and the frequency of how often those algorithms run. The default parameters may be calibrated for optimal information gathering during normal operation. However, specific events may trigger a change in these parameters, to gather more precise information for that event. A change could be data collection with a higher frequency over a short period of time, even though it may not be sustainable for long because the unit does not have the CPU power or storage capacity for the analysis. For example, when the bogie diagnostics computer system of a leading train car detects an anomaly, it can ask the following bogies to temporarily reconfigure its system to look for a specific aspect when the bogie drives over the specify location on the tack (e.g., at 200 kph and a train of 300 m the last bogie will cross the location of the first bogie 3.6 s later). The reconfiguration may include disabling some algorithms, changing the sample speed of the data, or running certain algorithms more often.

Bogie characteristics change over time (e.g., diameter of wheel due to abrasion and resurfacing). Some or all of that information may not be available on the bogie diagnostics computer system, mostly due to additional complexity which would impose on maintenance. However, this information can be reconstructed by comparing the signals of the different bogies with each other. For example, the new wheel diameter can be identified by the computer when it requests the current rotations per minute (RPM) of the axis of the other bogies and compares those values with its own.

A train control system is located in the first train car 105A. The train control system generally performs various functions related to controlling the train operation. For the purpose of anomaly detection, the train control system receives anomaly detection messages from bogie diagnostics computer systems. The train control system also receives confirmation messages from bogie diagnostics computer systems that confirm the original anomaly detection. In response to receiving the confirmation message, the train control system may perform operations such as sending a notification of the track anomalies to at least one system external to the train. Also, as described in further detail below, in some embodiments, the train control system may generate a map of the track with the detected anomalies.

The bogie diagnosis computer systems and the train control system are all connected via communications network 110. This communication network 110 may utilize conventional transmission technologies including, for example, Ethernet and Wi-Fi to facilitate communications between the train cars. Each bogie diagnosis computer system may implement one or more transport layer protocols generally known in the art such as TCP and/or UDP. In some embodiments, the bogie diagnosis computer system includes functionality that allows the transport protocol to be selected based on real-time requirements or a guaranteed quality of service. For example, for near-real time communications UDP may be used by default, while TCP is used for communications which have more lax timing requirements but require additional reliability.

Figure 2:
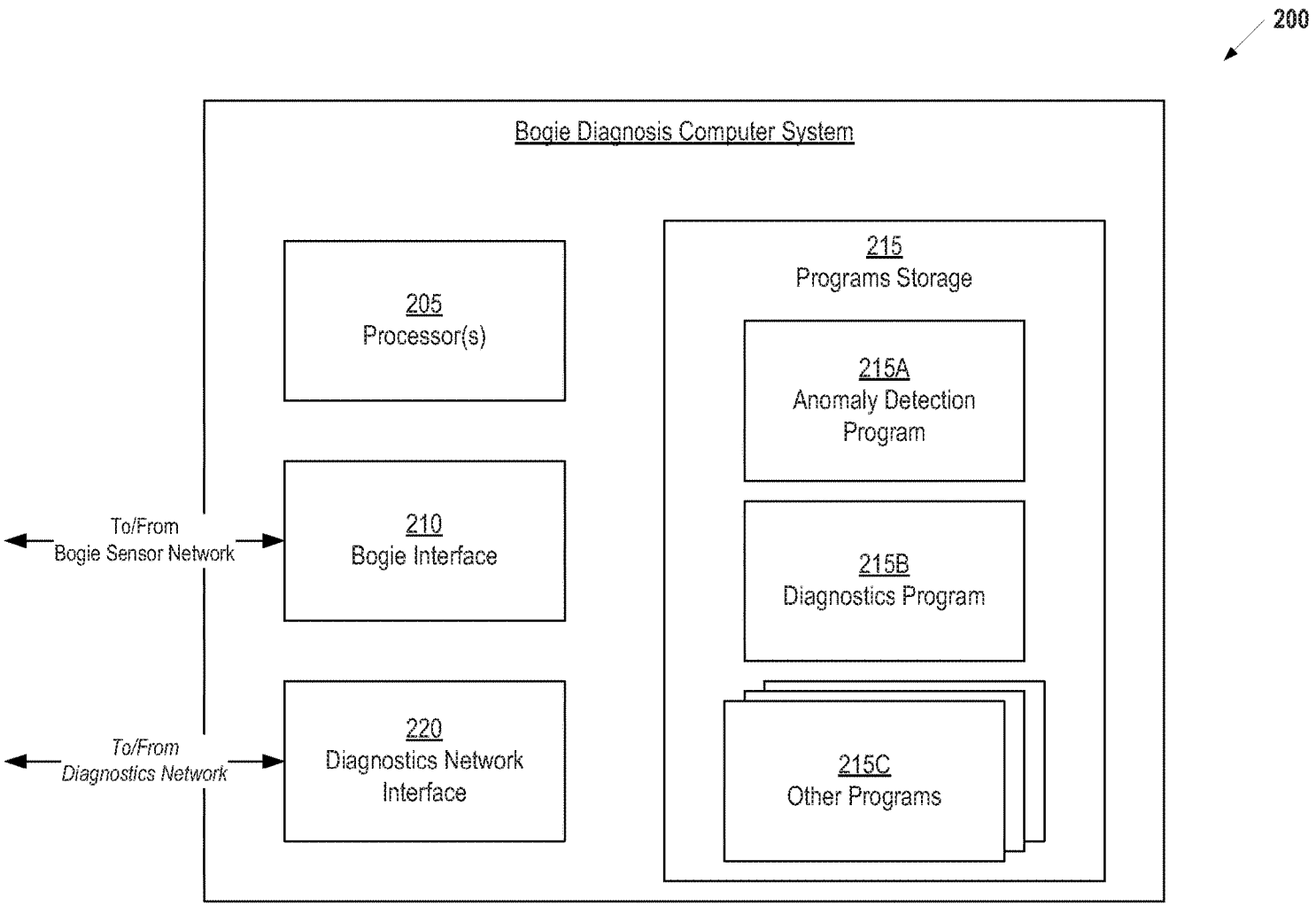
FIG. 2 illustrates an example Bogie Diagnostics Computer System, according to some embodiments.

FIG. 2 illustrates an example Bogie Diagnostics Computer System 200, according to some embodiments. This example includes two interfaces for receiving data from external systems. First, a Bogie Interface 210 is configured to facilitate communication with the bogie sensor network. In some embodiments, the bogie sensor network is directly connected to the Bogie Diagnostics Computer System 200 such that the task of the Bogie Interface 210 is primarily to encode and decode sensor data, as necessary, and perform any pre-processing that is required for processing the bogie sensor data. In other embodiments, one or more networks may be connected to the Bogie Diagnostics Computer System 200 with the bogie sensor network. For example, in some embodiments, the Bogie Diagnostics Computer System 200 and the bogie sensor network are connected through a wireless local area network. In this case, the Bogie Interface 210 will additionally include functionality for supporting the networking protocols used for communication. The Diagnostics Network Interface 220 is configured in a similar manner to the Bogie Interface 210, except the former is used to connect to the network connecting the Bogie Diagnostics Computer System 200 with the other bogie diagnostics computer systems and other computing systems (e.g., a train control system) present on the train. As noted above with respect to FIG. 1, a diagnostics network connects the various systems on the train. The Diagnostics Network Interface 220 implements the protocol(s) and performs any other tasks necessary to send and receive data on the network.

Continuing with reference to FIG. 2, the Bogie Diagnostics Computer System 200 further includes one or more Processors 205 and a Program Storage 215 storing a plurality of software programs executable by the Processors 205. The Program Storage 215 may be implemented using any non-transitory computer readable medium known in the art. The programs include an Anomaly Detection Program 215A, a Diagnostics Program 215B, and one or more Other Programs 215C.

The Anomaly Detection Program 215A is configured to detect track anomalies based on the sensor data collected by the Bogie Interface 210. The Anomaly Detection Program 215A may execute one or more algorithms that analyze data from the bogie sensor network and try to detect any irregularities, unexpected variances, or other anomalies in the data. If any anomalies are detected, the Anomaly Detection Program 215A may use the Diagnostics Network Interface 220 to send an anomaly detection message to the other systems of the train (e.g., using a broadcast or multicast message).

Computationally, the processing resources of the Bogie Diagnostics Computer System 200 may not allow processing and storage of highly sampled data over extended periods of time. For this reason, the Anomaly Detection Program 215A executed with a sampling rate parameter that allows the sampling of bogie sensor data to be increased or decreased, as desired. For example, if the Bogie Diagnostics Computer System 200 receives a notification that a potential anomaly is located at a particular location on the track, the sampling rate of the Anomaly Detection Program 215A may be increased when the bogies associated with the Bogie Diagnostics Computer System 200 are passing over the location.

The Diagnostics Program 215B performs general operations of the Bogie Diagnosis Computer System 200 and manages execution of the programs in the Program Storage 215. For example, in one embodiment, the Diagnostics Program 215B is configured to increase the sampling rate of the Anomaly Detection Program 215A in response to receiving an anomaly detection message from at least one other bogie diagnostics computer system. Alternatively (or additionally), the Diagnostics Program 215B may be configured to disable one or more of the Other Programs 215C when anomaly detection message is received to allow the full processing resources of the Bogie Diagnosis Computer System 200 to be dedicated to anomaly detection.

Figure 3:
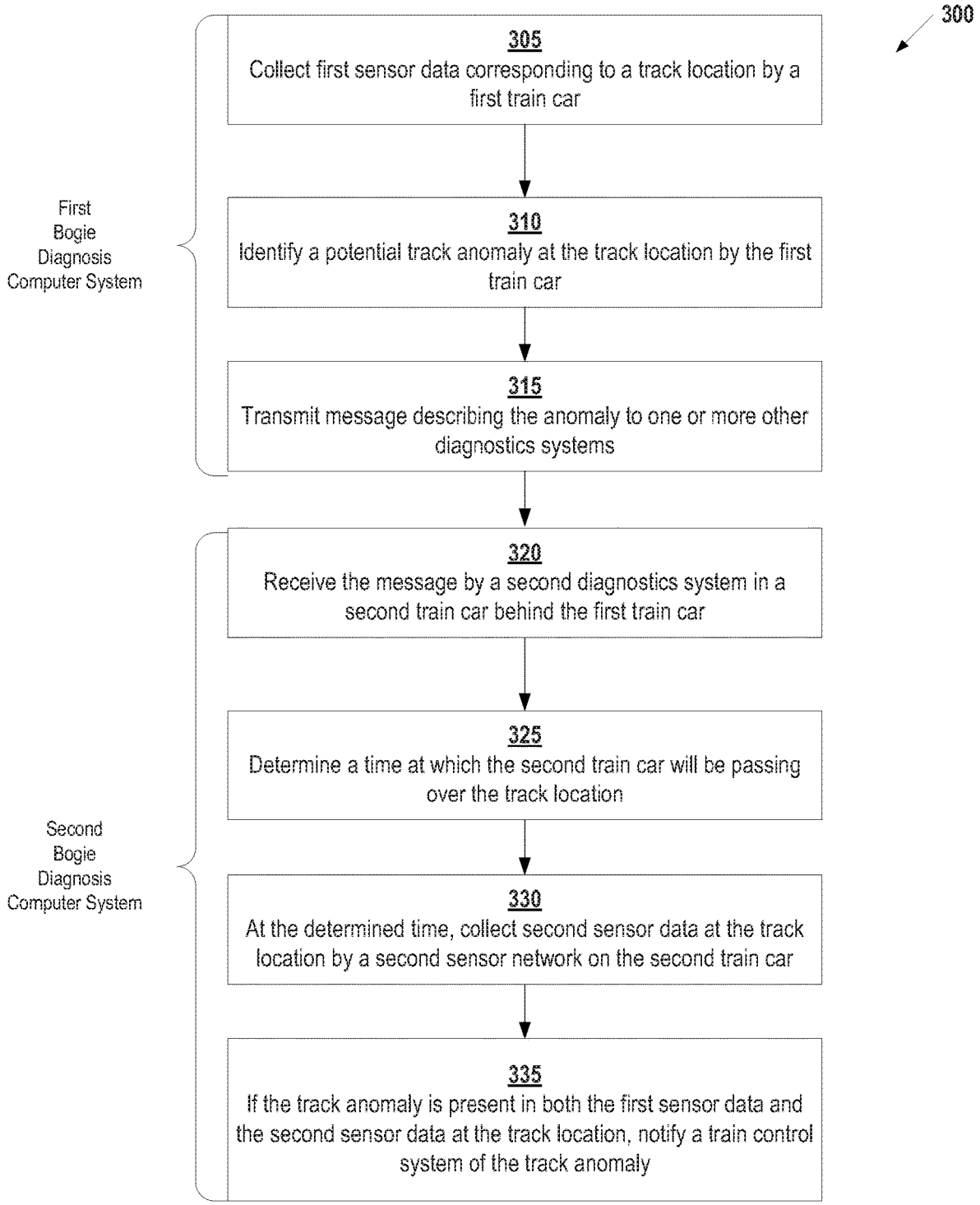
FIG. 3 illustrates a method of monitoring track condition, according to some embodiments.

FIG. 3 illustrates a method 300 of monitoring track condition, according to some embodiments. This method may be performed, for example, by one or more bogie diagnosis computer systems (see FIG. 2). Starting at step 305, first sensor data corresponding to a track location is collected from a first sensor network on a first train car. In some embodiments, the track location is determined based on a Global Positioning System (GPS) signal received by the diagnostics system on the first train car. In other embodiments, the diagnostics system may receive readings of one or more location markings on the track (e.g., via the bogie sensor system). Then, the track location may be determined based on the location markings. For example, the rail system of the track may include a radio frequency identification device (RFID) tag or similar device that provides the latitude and longitude of a particular section of the track. As the bogie sensor system passes over the section, it receives the latitude and longitude from the RFID tag and uses it to update its internal positioning system. RFID tags may be distributed along the track system to provide location information at regular intervals and techniques such as dead reckoning which can be used to approximate position information between points.

Based on the first sensor data, at step 310 a potential track anomaly is identified at the track location by a first diagnostics system on the first train car (e.g., using the Anomaly Detection Program 215A). At step 315, a message describing the anomaly from the first diagnostics system is transmitted to diagnostics systems located on one or more other train cars included in the train. This message comprises an indication of the track location and, optionally, a description of the anomaly. In general, any technique known in the art may be used for passing messages between various components. For example, in some embodiments, the messages are designed to fit in a single IP packet to allow rapid communication of information between different computing systems. For example, in one embodiment, a notification message may comprise one or more fields describing the type of notification (e.g., new anomaly, confirmation of existing anomaly, etc.), while another field stores location information. In other embodiments, a file may be used to transfer message information using a format such as Extensible Markup Language (XML). This allows more detailed information to be sent with each transmission.

At step 320, the message is received by a second diagnostics system on a second train car located behind the first train with respect to the train's direction of travel. In principle, trains ahead and behind the first train may receive the message. For example, in one embodiment, the notification message is transmitted using broadcast or multicast such that all computers connected to the diagnostics communication network can receive the message. However, the cars trailing the first car with respect to the train's direction of travel will have the opportunity to confirm the anomaly because the cars have not yet passed the anomaly on the track.

At step 325, the second diagnostics system determines the time at which the second train car will be passing over track location. This time will depend on factors such as the speed of the train, the length of cars, the diameter of the wheels, etc. Because the design of each train may be different, each individual diagnostics system may be configured to calculate time differently. For example, upon linking up with a train, a diagnostics system may receive a car number indicating which car they are in the train system (e.g., "1" for the first car, "2" for the second car, etc.). Additionally, the diagnostics system may maintain information about the physical design of the bearings, shafts, brakes and wheels, as well as the overall length over the bogie. In some embodiments, this information may be updated over time, for example, as wheels shrink in diameter from use. To calculate speed a particular train may retrieve the current train speed from an external system (e.g., the train control system) or calculate it locally. Finally, with the car number, design information, and speed, location can be predicted. For example, the diagnostics system may predict that, given the current speed, the wheels of the car should pass over the location of the potential anomaly in exactly 10 seconds.

At step 330, second sensor data is collected at the determined time and at the track location by the sensor network on the second train car. In some embodiments, prior to collecting the second sensor data and in response to receiving the message, the second diagnostics system may perform operations such as increasing sampling speed of the bogie sensor network on the second train car, enabling data collection algorithms that include functionality related to detection of the anomaly, or disabling data collection algorithms with functionality unrelated to detection of the anomaly. Examples of the type of functionality that may be enabled include reasoning logic (e.g., is the anomaly caused by a track issue or was it just a temporary issue like a stone on the track) and verification if car one had a faulty sensor read.

Then, at step 335, if the track anomaly is present in both the first sensor data and the second sensor data at the track location, the train control system is notified of the track anomaly. Once the train control system receives this notification, it may perform various operations. For example, in some embodiments, the train control system sends an anomaly notification message to an external source such as the regional train management system. This anomaly notification message may provide information such as the location of the anomaly and the type of anomaly (if known). Additionally, configuration information such as the details of the system recording the sensor data, the number of diagnostic systems confirming the anomaly, etc. may also be included in the anomaly detection message. Alternatively (or additionally), the train control system may use the information to generate a map of the track as described below with respect to FIG. 4.

In the systems described above, anomaly detection is performed cooperatively among cars of the train. This general framework can be scaled to perform anomaly detection across trains. For example, in one embodiment, the modified map of the track can be verified by other trains passing that location at a later time. The map can also be used by other trains to adjust their operating conditions (e.g., reduce speed if track failure).

Figure 4:
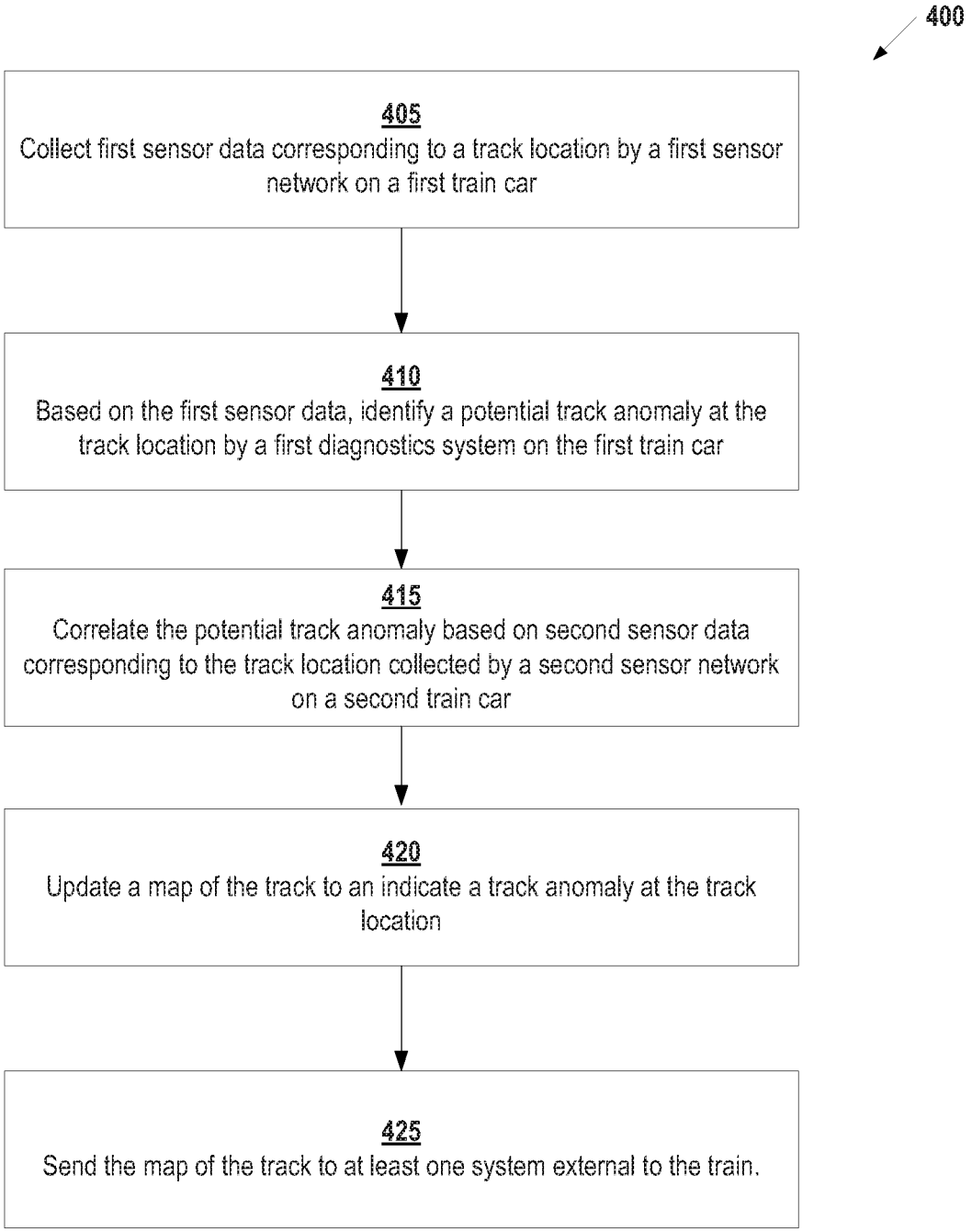
FIG. 4 shows a method for generating a map of a track using the anomaly detection system described herein.

FIG. 4 shows a method 400 for generating a map of a track using the anomaly detection system described herein. Starting at step 405, the diagnostics system on a first train car collects sensor data from its local sensor network at a track location. At step 410, a potential track anomaly at the track location is identified based on the collected sensor data. Next, at step 415, the potential track anomaly is correlated by a second train car by collecting sensor data using its local sensor network at the track location. Once the anomaly is correlated, at step 420 it is used to update a map of the track to indicate a track anomaly at the track location. In general, any map file format known in the art may be used to encode the geographical information from the track into a computer file. For example, in one embodiment, the track information is encoded to a geographic information system (GIS) file format such Shapefile or Keyhole Markup Language (KML). The map may be generated locally or remotely from the train. In the example of FIG. 4, the map is generated by the train control system and, at step 425, the map is relayed to an external system that is remote from the train. In other embodiments, the map is generated at the external system based on information provided by the train (e.g., anomalies and associated location information).

Figure 5:
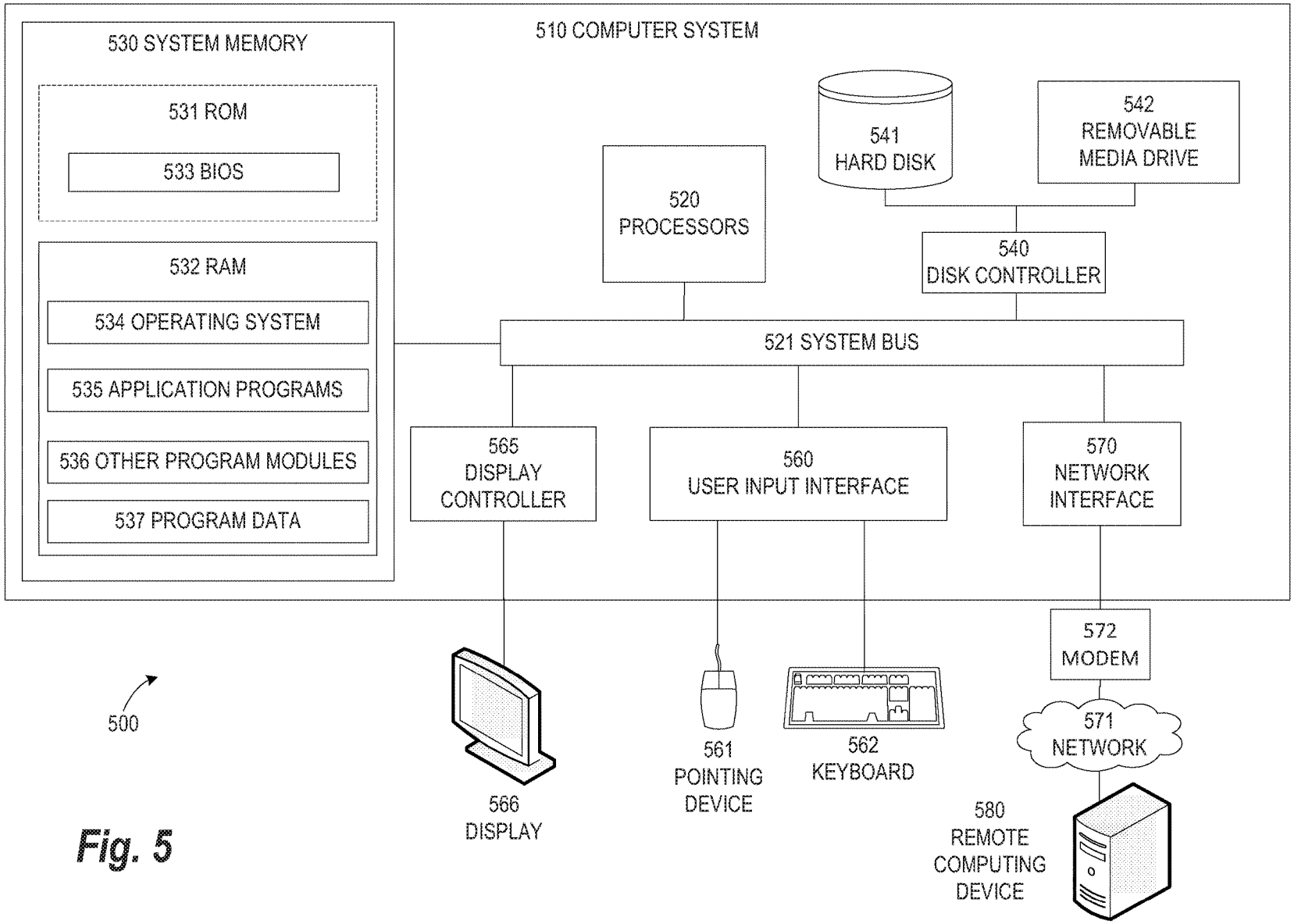
FIG. 5 illustrates an exemplary computing environment within which embodiments of the invention may be implemented.

FIG. 5 illustrates an exemplary computing environment 500 within which embodiments of the invention may be implemented. For example, this computing environment 500 may be used to implement bogie diagnostics computer system described above with respect to FIGS. 1 and 2. The computing environment 500 includes computer system 510, which is one example of a computing system upon which embodiments of the invention may be implemented. Computers and computing environments, such as computer system 510 and computing environment 500, are known to those of skill in the art and thus are described briefly here.

As shown in FIG. 5, the computer system 510 may include a communication mechanism such as a bus 521 or other communication mechanism for communicating information within the computer system 510. The computer system 510 further includes one or more processors 520 coupled with the bus 521 for processing the information. The processors 520 may include one or more central processing units (CPUs), graphical processing units (GPUs), or any other processor known in the art.

The computer system 510 also includes a system memory 530 coupled to the bus 521 for storing information and instructions to be executed by processors 520. The system memory 530 may include computer readable storage media in the form of volatile and/or nonvolatile memory, such as read only memory (ROM) 531 and/or random access memory (RAM) 532. The system memory RAM 532 may include other dynamic storage device(s) (e.g., dynamic RAM, static RAM, and synchronous DRAM). The system memory ROM 531 may include other static storage device (s) (e.g., programmable ROM, erasable PROM, and electrically erasable PROM). In addition, the system memory 530 may be used for storing temporary variables or other intermediate information during the execution of instructions by the processors 520. A basic input/output system 533 (BIOS) containing the basic routines that help to transfer information between elements within computer system 510, such as during start-up, may be stored in ROM 531. RAM 532 may contain data and/or program modules that are immediately accessible to and/or presently being operated on by the processors 520. System memory 530 may additionally include, for example, operating system 534, application programs 535, other program modules 536 and program data 537.

The computer system 510 also includes a disk controller 540 coupled to the bus 521 to control one or more storage devices for storing information and instructions, such as a hard disk 541 and a removable media drive 542 (e.g., floppy disk drive, compact disc drive, tape drive, and/or solid state drive). The storage devices may be added to the computer system 510 using an appropriate device interface (e.g., a small computer system interface (SCSI), integrated device electronics (IDE), Universal Serial Bus (USB), or FireWire).

The computer system 510 may also include a display controller 565 coupled to the bus 521 to control a display 566, such as a cathode ray tube (CRT) or liquid crystal display (LCD), for displaying information to a computer user. The computer system includes an input interface 560 and one or more input devices, such as a keyboard 562 and a pointing device 561, for interacting with a computer user and providing information to the processor 520. The pointing device 561, for example, may be a mouse, a trackball, or a pointing stick for communicating direction information and command selections to the processor 520 and for controlling cursor movement on the display 566. The display 566 may provide a touch screen interface which allows input to supplement or replace the communication of direction information and command selections by the pointing device 561.

The computer system 510 may perform a portion or all of the processing steps of embodiments of the invention in response to the processors 520 executing one or more sequences of one or more instructions contained in a memory, such as the system memory 530. Such instructions may be read into the system memory 530 from another computer readable medium, such as a hard disk 541 or a removable media drive 542. The hard disk 541 may contain one or more datastores and data files used by embodiments of the present invention. Datastore contents and data files may be encrypted to improve security. The processors 520 may also be employed in a multi-processing arrangement to execute the one or more sequences of instructions contained in system memory 530. In alternative embodiments, hard-wired circuitry may be used in place of or in combination with software instructions. Thus, embodiments are not limited to any specific combination of hardware circuitry and software.

As stated above, the computer system 510 may include at least one computer readable medium or memory for holding instructions programmed according to embodiments of the invention and for containing data structures, tables, records, or other data described herein. The term "computer readable medium" as used herein refers to any medium that participates in providing instructions to the processor 520 for execution. A computer readable medium may take many forms including, but not limited to, non-volatile media, volatile media, and transmission media. Non-limiting examples of non-volatile media include optical disks, solid state drives, magnetic disks, and magneto-optical disks, such as hard disk 541 or removable media drive 542. Non-limiting examples of volatile media include dynamic memory, such as system memory 530. Non-limiting examples of transmission media include coaxial cables, copper wire, and fiber optics, including the wires that make up the bus 521. Transmission media may also take the form of acoustic or light waves, such as those generated during radio wave and infrared data communications.

The computing environment 500 may further include the computer system 510 operating in a networked environment using logical connections to one or more remote computers, such as remote computer 580. Remote computer 580 may be a personal computer (laptop or desktop), a mobile device, a server, a router, a network PC, a peer device or other common network node, and typically includes many or all of the elements described above relative to computer system 510. When used in a networking environment, computer system 510 may include modem 572 for establishing communications over a network 571, such as the Internet. Modem 572 may be connected to bus 521 via user network interface 570, or via another appropriate mechanism.

Network 571 may be any network or system generally known in the art, including the Internet, an intranet, a local area network (LAN), a wide area network (WAN), a metropolitan area network (MAN), a direct connection or series of connections, a cellular telephone network, or any other network or medium capable of facilitating communication between computer system 510 and other computers (e.g., remote computer 580). The network 571 may be wired, wireless or a combination thereof. Wired connections may be implemented using Ethernet, Universal Serial Bus (USB), RJ-11 or any other wired connection generally known in the art. Wireless connections may be implemented using Wi-Fi, WiMAX, and Bluetooth, infrared, cellular networks, satellite or any other wireless connection methodology generally known in the art. Additionally, several networks may work alone or in communication with each other to facilitate communication in the network 571.

The embodiments of the present disclosure may be implemented with any combination of hardware and software. In addition, the embodiments of the present disclosure may be included in an article of manufacture (e.g., one or more computer program products) having, for example, computer-readable, non-transitory media. The media has embodied therein, for instance, computer readable program code for providing and facilitating the mechanisms of the embodiments of the present disclosure. The article of manufacture can be included as part of a computer system or sold separately.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

An executable application, as used herein, comprises code or machine readable instructions for conditioning the processor to implement predetermined functions, such as those of an operating system, a context data acquisition system or other information processing system, for example, in response to user command or input. An executable procedure is a segment of code or machine readable instruction, sub-routine, or other distinct section of code or portion of an executable application for performing one or more particular processes. These processes may include receiving input data and/or parameters, performing operations on received input data and/or performing functions in response to received input parameters, and providing resulting output data and/or parameters.

A graphical user interface (GUI), as used herein, comprises one or more display images, generated by a display processor and enabling user interaction with a processor or other device and associated data acquisition and processing functions. The GUI also includes an executable procedure or executable application. The executable procedure or executable application conditions the display processor to generate signals representing the GUI display images. These signals are supplied to a display device which displays the image for viewing by the user. The processor, under control of an executable procedure or executable application, manipulates the GUI display images in response to signals received from the input devices. In this way, the user may interact with the display image using the input devices, enabling user interaction with the processor or other device.

The functions and process steps herein may be performed automatically or wholly or partially in response to user command. An activity (including a step) performed automatically is performed in response to one or more executable instructions or device operation without user direct initiation of the activity.

The system and processes of the figures are not exclusive. Other systems, processes and menus may be derived in accordance with the principles of the invention to accomplish the same objectives. Although this invention has been described with reference to particular embodiments, it is to be understood that the embodiments and variations shown and described herein are for illustration purposes only. Modifications to the current design may be implemented by those skilled in the art, without departing from the scope of the invention. As described herein, the various systems, subsystems, agents, managers and processes can be implemented using hardware components, software components, and/or combinations thereof. No claim element herein is to be construed under the provisions of 35 U.S.C. 112, sixth paragraph, unless the element is expressly recited using the phrase "means for."

The invention claimed is:

1. A method of monitoring a track using a train comprising a plurality of train cars, the method comprising: linking up with a first train car, a first diagnostics system on the first train car, wherein the first diagnostics system comprises a first one or more processors and a first anomaly detection program configured to detect track anomalies based on sensor data collected by a first sensor network on the first train car, and wherein the first diagnostics system maintains design information of the first train car;

collecting first sensor data corresponding to a track location by the first sensor network on the first train car;

based on the first sensor data, identifying a potential track anomaly at the track location by the first anomaly detection program;

transmitting a message describing the anomaly from the first diagnostics system to diagnostics systems located on one or more other train cars included in the train, wherein the message comprises an indication of the track location;

linking up with a second train car located behind the first train car with respect to the train's direction of travel, a second diagnostics system on the second train car, wherein the second diagnostics system comprises a second one or more processors and a second anomaly detection program configured to detect track anomalies based on sensor data collected by a second sensor network on the second train car, and wherein the second diagnostics system maintains design information of the second train car;

receiving the message by the second diagnostics system;

determining, by the second diagnostics system, a time at which the second train car will be passing over track location, based on the design information of the second train car;

at the determined time, collecting second sensor data at the track location by the second sensor network on the second train car for identifying a track anomaly at the track location by the second anomaly detection program; and if the track anomaly is present in both the first sensor data and the second sensor data at the track location, notifying a train control system of the track anomaly.

2. The method of claim 1, further comprising: prior to collecting the second sensor data and in response to receiving the message, increasing a sampling rate used by the second diagnostics system for collecting the second sensor data by the second sensor network on the second train car.

3. The method of claim 1, further comprising:

prior to collecting the second sensor data and in response to receiving the message, enabling one or more data collection algorithms with functionality related to detection of the anomaly.

4. The method of claim 1, further comprising:

prior to collecting the second sensor data and in response to receiving the message, disabling one or more data collection algorithms with functionality unrelated to detection of the anomaly.

5. The method of claim 1, further comprising:

determining the track location based on a Global Positioning System (GPS) signal received by the first diagnostics system on the first train car.

6. The method of claim 1, further comprising:

reading one or more location markings on the track; and determining the track location based on the one or more location markings.

7. The method of claim 1, further comprising:

sending, by the train control system, a notification of the track anomaly to at least one system external to the train.

8. The method of claim 1, further comprising:

updating, by the train control system, a map of the track to indicate the track anomaly at the track location.

9. The method of claim 8, further comprising:

sending, by the train control system, the map of the track to at least one system external to the train.

* * * * *